United States Patent [19]

Olsen

[11] Patent Number: 5,049,104

[45] Date of Patent: Sep. 17, 1991

[54] CONNECTING MEANS FOR A TOY BUILDING SET

[75] Inventor: Flemming H. Olsen, Espergaerde, Denmark

[73] Assignee: Interlego A.G., Baar, Switzerland

[21] Appl. No.: 485,215

[22] Filed: Feb. 26, 1990

[30] Foreign Application Priority Data

Feb. 24, 1989 [DK] Denmark ..... 872/89

[51] Int. Cl.[5] ..... A63H 33/12; A63H 33/04; A63H 33/08; F16C 11/06

[52] U.S. Cl. ..... 446/104; 446/86; 446/116; 446/123; 403/156; 403/159

[58] Field of Search ..... 446/104, 102, 85, 86, 446/106, 108, 116, 120, 121, 122, 123, 124, 125, 381, 378, 377, 376; 403/156, 154, 159, 161, 162, 163

[56] References Cited

U.S. PATENT DOCUMENTS

| | | | |
|---|---|---|---|
| 220,878 | 10/1879 | Shiflett | 403/159 |
| 918,225 | 4/1909 | Townley | 403/159 |
| 1,607,300 | 11/1926 | Parker | 446/124 X |
| 1,678,709 | 7/1928 | Schürmann | 446/104 X |
| 1,985,032 | 12/1934 | Hoult | 446/122 |
| 2,293,559 | 8/1942 | Patterson | 403/159 X |
| 3,277,601 | 10/1966 | Ryan | 446/378 |
| 3,628,282 | 12/1971 | Johnson | 446/378 X |
| 4,929,113 | 5/1990 | Sheu | 403/162 X |

FOREIGN PATENT DOCUMENTS

| | | | |
|---|---|---|---|
| 0127397 | 12/1984 | European Pat. Off. | 446/120 |
| 179642 | 11/1921 | United Kingdom | 446/378 |

*Primary Examiner*—David N. Muir

*Attorney, Agent, or Firm*—Kane, Dalsimer, Sullivan, Kurucz, Levy, Eisele and Richard

[57] ABSTRACT

A connecting system for a toy building set comprises a first coupling part (11) and a second coupling part (12, 13), which are provided on their respective ones of a pair of building elements, adapted to be interconnected, and are formed with respective complementary coupling elements (11, 12, 13). The coupling parts in the connecting elements of the invention are adapted to interconnect the elements by elastic movement of at least one coupling part. This interconnection is flexible and may be fixed with a clamping device (16), which blocks the elastic movement.

11 Claims, 4 Drawing Sheets

CONNECTING MEANS FOR A TOY BUILDING SET

BACKGROUND OF THE INVENTION

The invention concerns a connecting means for a toy building set. More particularly, it concerns a connecting means which can be used for interconnecting respective toy elements when erecting mechanical structures.

Various forms of construction toys are known, comprising a plurality of construction and coupling means.

For example the CA patent specification 878 619 discloses a building system where elements with holes are interconnected by means of bolts and nuts. Building systems of this type have the drawback that it is difficult for small children to use them since the children cannot both hold the parts in a specific mutual position and also have two hands available for fixing bolts and nuts.

The GB patent specification 1 285 185 discloses a similar building system where pegs are additionally provided on the elements for cooperation with holes in other elements. This enables temporary coupling of two elements, but gives no possibility of erecting a complete, stable structure.

SUMMARY OF THE INVENTION

The object of the invention is to provide a toy building set which is unique in including compact elements, which comprise integrated means for temporary attachment and which are adapted to fix and secure mutually coupled elements effectively.

This is achieved in that, as stated in the characterizing portion of claim 1, a connecting means comprises a first coupling part and a second coupling part, said parts being provided on their respective ones of a pair of building elements, adapted to be interconnected, and formed with respective, complementary coupling means, said coupling parts being adapted to interconnect the elements by elastic movement of at least one coupling part. This interconnection is flexible and may be made permanent by means of an adjustable clamping device for blocking the elastic movement.

Thus, a simple, compact and functional toy building set is provided, permitting rapid erection of structures by means of the snap lock principle and simple clamping through the aid of means integrated in the elements.

Claim 11 defines an advantageous embodiment of the coupling parts with a view to providing the elastic movement when joining two complementary coupling parts.

Claims 2-5 define various advantageous details of the clamping device; claim 9 states that it comprises a thread of great pitch enabling rapid clamping; claims 3 and 4 state that the coupling device is operative in connection with a device for disengaging an applied tightening torque when this exceeds a certain limit. The disengagement device operates in one direction of rotation, which prevents the elements from being destroyed when the clamping device is excessively tightened; and claim 5 states that the clamping device is provided with a snap lock, preventing it from dropping out of the element when loosened.

The mutually cooperating depressions defined in claim 10 enable fixing of the parts in various mutual positions. When, as stated in claim 6, the projections are formed as resilient tongues, a click function is obtained in certain positions with movability between these. Claims 7 and 8 state that parts, subjected to wear in use, can advantageously be arranged in a separate part, which may optionally be exchangeable, but to render exchange superfluous, it is preferably made of a more wear-resistant and therefore more expensive material than the rest of the means, which does not need to have the same wear resistance and can therefore be made of a less expensive material.

The invention will be explained more fully below with reference to the drawing, in which

BRIEF DESCRIPTION OF THE DRAWINGS

FIG. 1 shows a preferred embodiment of a building element 10, intended to be connected with other elements by a connecting means according to the invention. In this case, the building element comprises a first coupling part 11 and two other coupling parts 12 and 13. It is evident to a skilled person that the number of coupling parts on a building element is immaterial; however, each building element must at least include a first coupling part and/or a second coupling part. Thus, building elements are conceivable which comprise only for example a first coupling part, since this element may thus be coupled with building elements comprising at least one second coupling part. The first coupling part 11 comprises a claw-shaped jaw part 14, while the second coupling part 12 and 13 comprises a bushing 15 and a clamping device 16.

FIG. 2 is a top view of the building element from FIG. 1. The second coupling part is shown without bushings, and, as will be seen, the second coupling part is formed with two collars 20 which, in combination with an associated cut 30 in the first coupling part (see FIG. 3), produces a snap lock effect when two corresponding coupling means are brought together. The snap lock effect may be generated in that at least one of the corresponding coupling parts is resilient, in this case the second coupling part, where for example the beam areas 21 and 22 move apart when the connecting means is engaged.

FIG. 3 shows a section through the building element from FIG. 2. It appears that the first coupling part is provided with cuts 30 which are complementary to the collars 20 of the second coupling part. A clamping device may be implemented by for example a screw whose head is concealed in a recess 31 and whose outer threads fit with inner threads 32 implemented in the building element. When the screw, with abutment in the recess 31, is tightened in the thread 32, the resilience in the second coupling part in question is removed, which causes a first coupling engaged with the second coupling part to be fixed. According to a preferred embodiment the thread pitch is great, which means that fixing can take place very rapidly without the screw having to be rotated noticeably. The screw may also be provided with a snap lock device on the shaft, which fixes it in the building element when the second coupling part has full resilience, i.e. that the screw cannot drop out of the building element when loosened. In the loosened state, the outer threads of the screw may moreover be out of engagement with the inner threads 32, so that in this state disengagement is involved. It is evident to a skilled person that the snap lock effect can also be provided in that the first coupling part is resilient instead of the second coupling part.

Since, according to the invention, the connecting means will typically be made of plastics, the clamping device—with a view to avoiding overloading—may be operatively connected with a disengagement device, so as to ensure that the clamping device can maximally be tightened with a predetermined torque. Such a disengagement device may either be integrated in the clamping device or be integrated in a clamping tool intended for the purpose. In the latter case, the use of unauthorized clamping tools may be prevented by forming the clamping device with a special coupling means intended for coupling with a complementary coupling means on the clamping tool.

Figure 1:
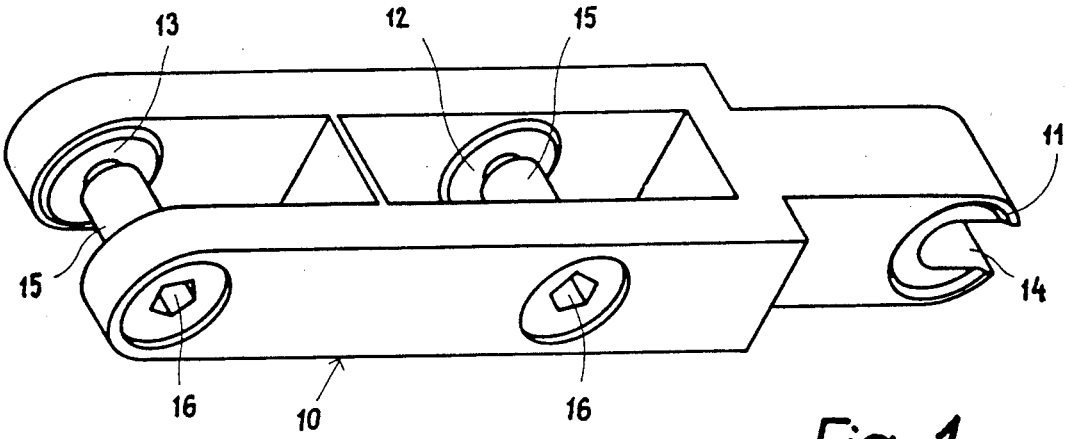
FIG. 1 shows a preferred embodiment of a building element provided with coupling parts according to the invention.
Figure 2:
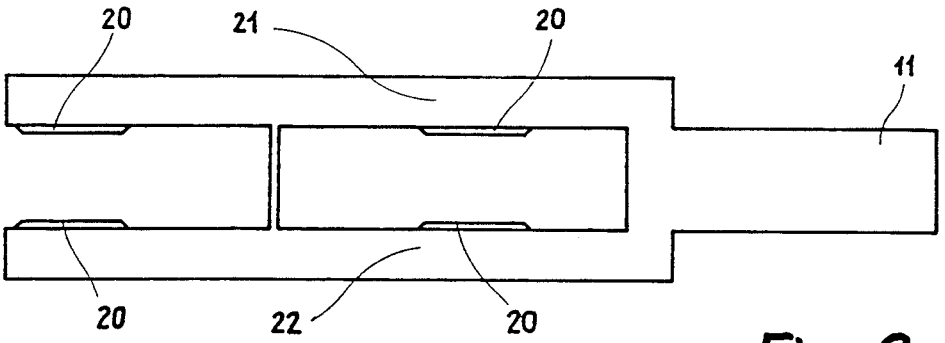
FIG. 2 is a top view of the building element from FIG. 1 (without clamping device)
Figure 3:
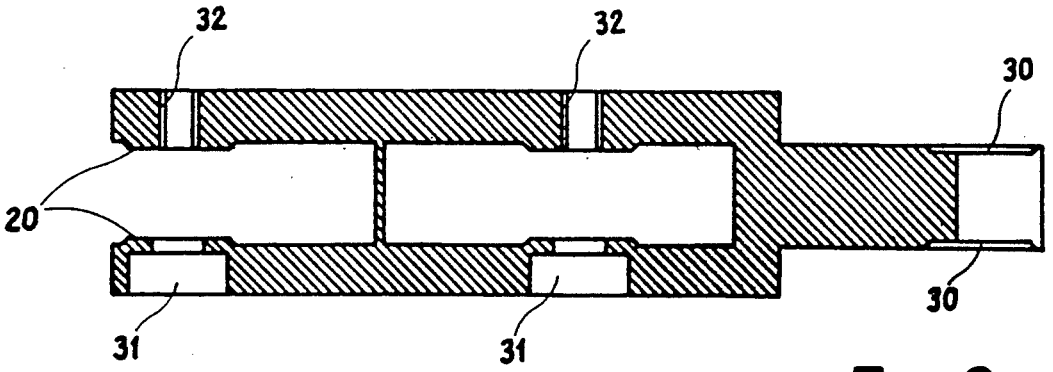
FIG. 3 shows a horizontal section through the element from FIG. 2, FIGS. 4 and 5 show examples of some possible connections between two building elements.
Figure 4:
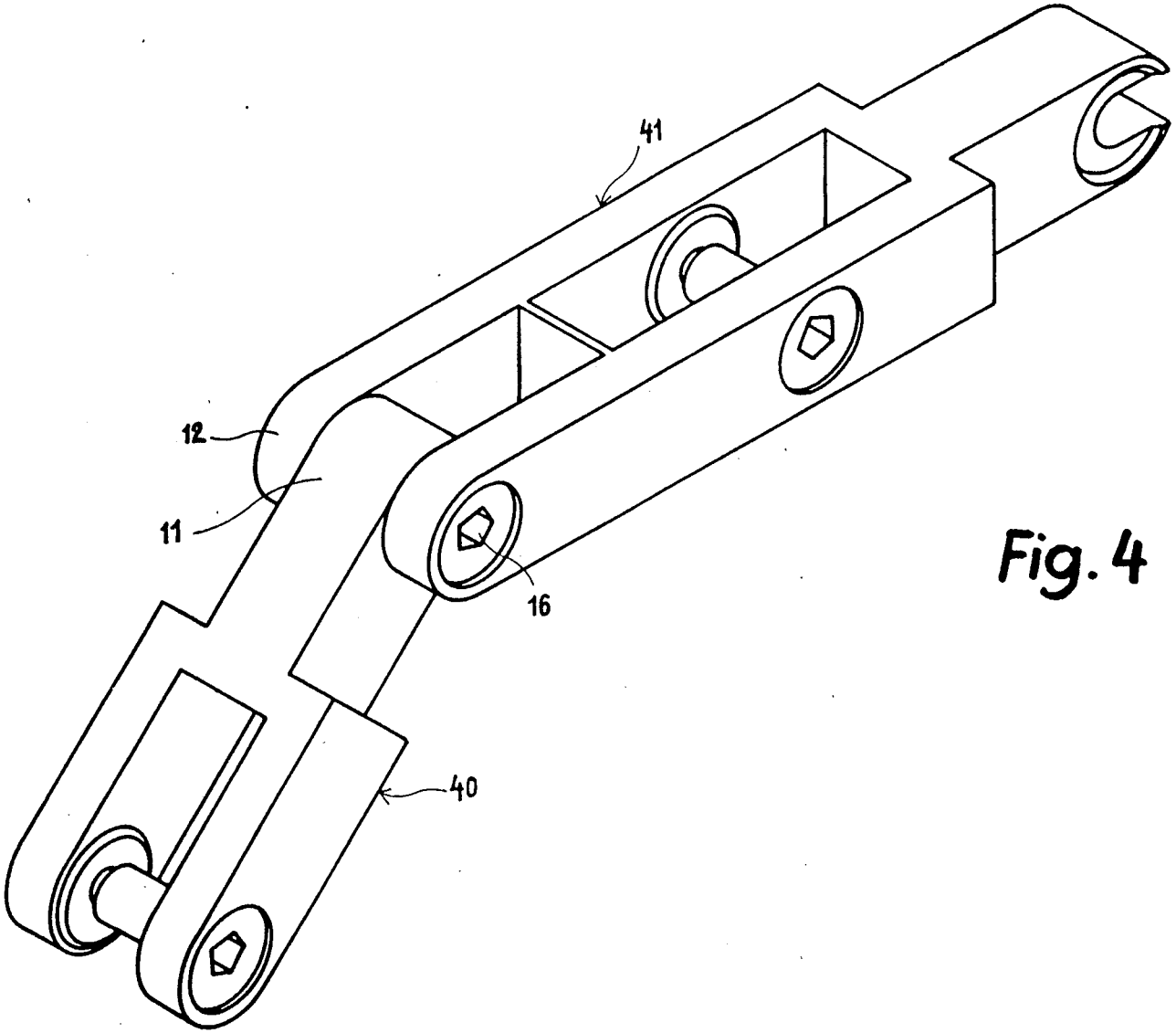
Figure 5:
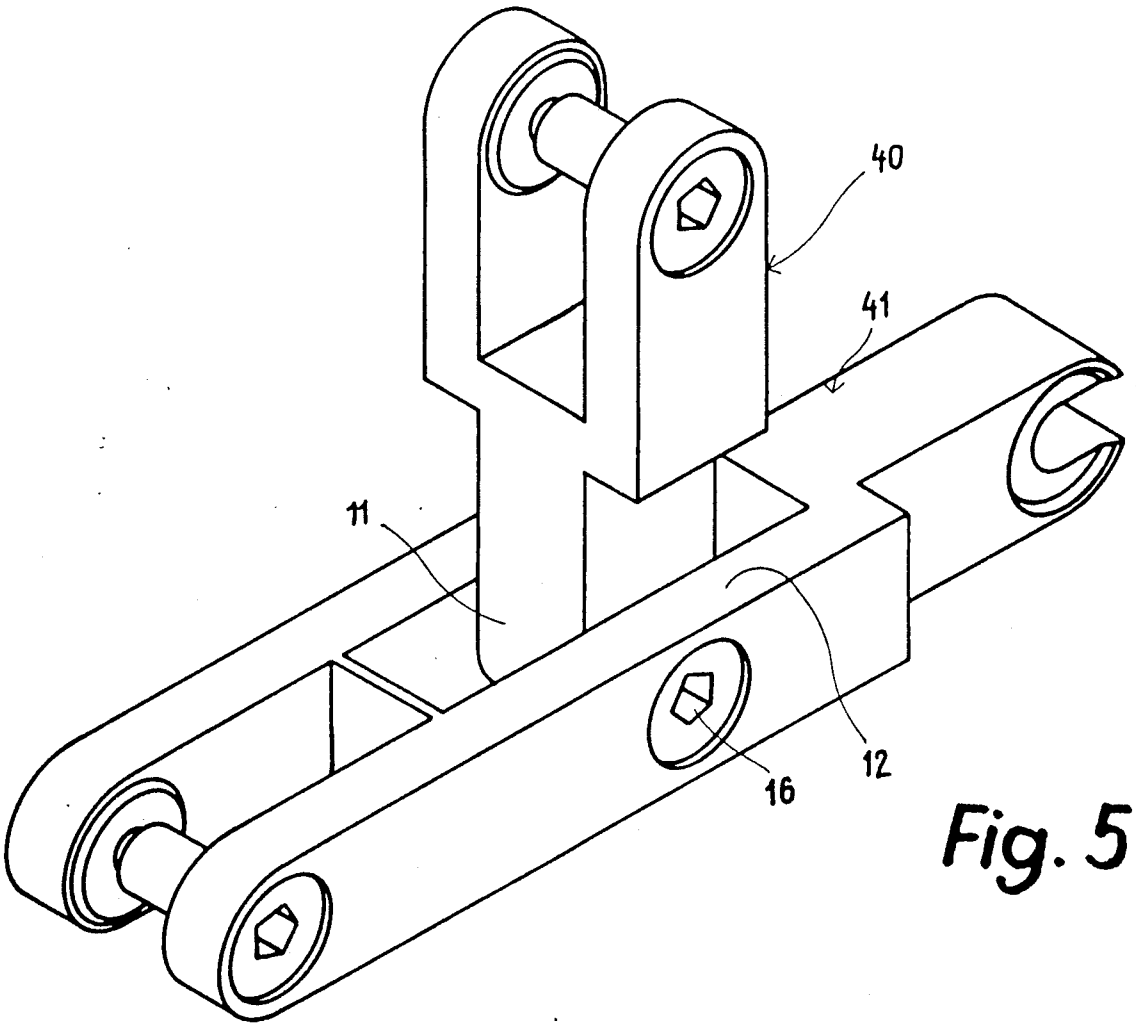

FIGS. 4 and 5 show some coupling possibilities between two building elements of the type shown in FIG. 1. A first coupling part 11 on a first building element 40 is caused to engage a second coupling part 12 on a second building element 41. In this state, the building elements will be mutually rotatable around the clamping device 16. The elements may now be locked in a desired position by rotation of the clamping device 16. As appears, the clamping device may be provided with a substantially pentagonal coupling means, which provides a safeguard against the use of unauthorized tools.

Figure 6:
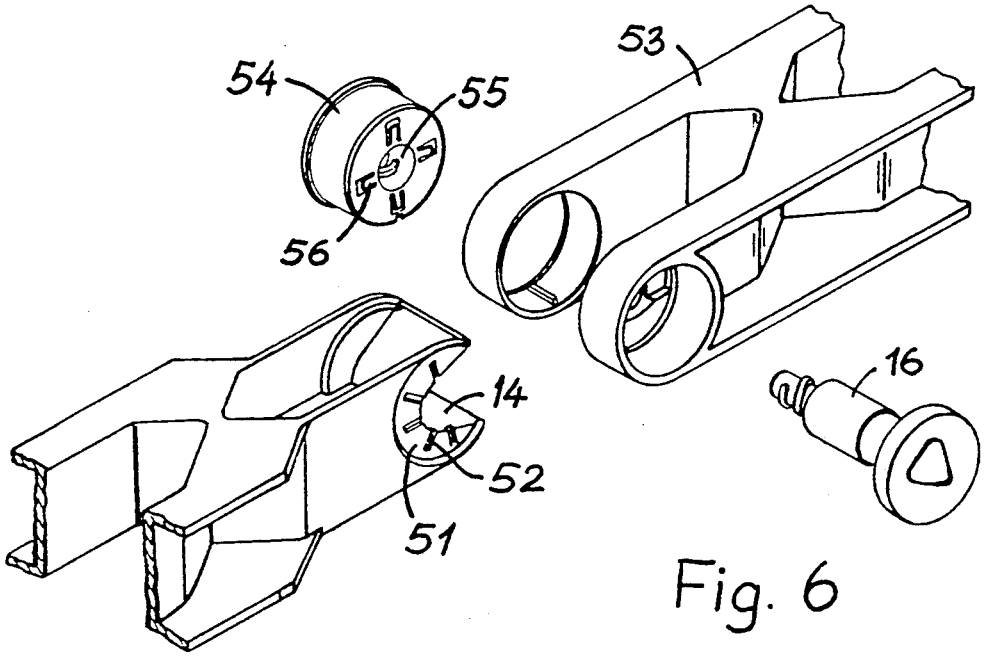
FIG. 6 is an exploded projection of parts of complementary coupling means in an alternative embodiment.

FIG. 6 shows an exploded projection of respective coupling parts. A first coupling part 51 essentially corresponds to the coupling part 11 and has likewise a claw-shaped jaw part 14. The first coupling part 51 is formed with a depression or cut like the cut 30, but is here provided with a plurality of radially extending depressions 52. The second coupling part comprises several separate parts in this embodiment. A separate part 54 is adapted to be mounted in the building element 53 where it is retained. The separate part 54 has a central hole 55 with threads to receive a screw 16 which is likewise threaded. The part 54 has a plurality of resilient tongues 56 on its inwardly directed end face, said tongues, in assembled state, cooperating with the depressions 52 in the first coupling part 51. The first and the second coupling part can hereby rotate with respect to each other, the cooperating depressions 52 and resilient tongues 56 providing a click function.

Figure 7:
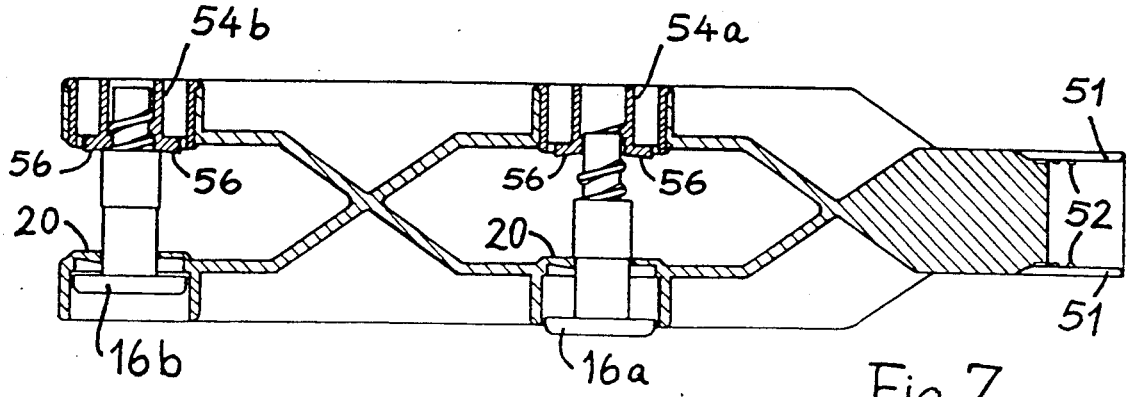
FIG. 7 shows a horizontal, central longitudinal section through an alternative coupling means in FIG. 6.

FIG. 7 shows a horizontal longitudinal section through a building element in the alternative embodiment. It is shown here how the two separate parts **54*a* and 54*b* are firmly mounted in the building element. A screw 16*a* is shown without threaded engagement with the treads in the part 54*a*, and it is prevented from dropping out since a jump in its outer diameter acts as a snap lock, as mentioned. A first coupling part can be coupled by the screw 16*a* with the shown coupling part since its jaws are here free to perform the necessary elastic movement for the coupling. A screw 16*b* is shown in engagement with the corresponding threads in the separate part 54*b*, and the outward elastic movement is blocked in this state by the parts of the building element adapted for this purpose, so that coupling and particularly separation of assembled building elements is prevented. When the screw 16 is screwed into the threads in the separate part 54**, clamping between these parts is established, and this allows in particular the unhindered mutual rotation of two assembled building elements, while their separation is prevented, as mentioned.

I claim:

1. A connector for a toy building set, comprising a first coupling part and a second coupling part complementary to said first coupling part, said first and second coupling parts being provided on respective ones of a pair of building set elements which are to be interconnected, characterized in that the coupling parts are adapted to interconnect the elements by elastic movement between a stressed condition of at least one of said coupling parts wherein said second coupling part may be inserted within portions of said first coupling parts and a relaxed condition of said one of said coupling parts wherein said second coupling part will be retained by said portions of said first coupling part whereby relative linear and angular displacement is retarded, and that said connecting means further includes a clamping means movable between a release position in which elastic movement of said one of said coupling parts between said stressed and relaxed conditions is possible and a lock position in which said elastic movement of said one of said coupling parts is prevented.

2. A connector according to claim 1 wherein said clamping means includes a bushing and wherein only the first coupling part is elastically movable, characterized in that the clamping device is integral with the bushing and serves, when activated, to limit the elastic movement of the one of the coupling parts.

3. A connector in accordance with claim 2 wherein said clamping means includes a screw and a mating threaded cavity to receive said screw and said connector further includes disengaging means whereby said screw threadedly engages said cavity when a tightening torque below a predetermined value is applied to the screw and disengages from said tightening torque if said predetermined value is exceeded.

4. A connector in accordance with claim 3 characterized in that the disengagement device is integrated in the screw.

5. A connector according to claim 4, characterized in that the clamping device comprises a screw said screw being provided with a snap lock so that in an unscrewed state it is fixed in the building elements in an axial direction.

6. A connector according to claim 5, characterized in that the projections are formed as resilient tongues.

7. A connector according to claim 6, characterized in that the resilient tongues are formed in a separate part, said separate part being mounted in said first coupling part.

8. A connector according to claim 7, characterized in that the separate part also comprises threads for the clamping device.

9. A connector in accordance with claim 2 wherein said clamping device is threaded.

10. A connector according to claim 1 or 4, characterized in that the coupling parts have mutually cooperating projections and depressions on respective ones of the parts.

11. A connector according to claim 1, characterized in that the elastic movement is provided by a collar on the first coupling part and a corresponding cut on the second coupling part.

* * * * *